US007939478B2

(12) United States Patent
Mayhew et al.

(10) Patent No.: US 7,939,478 B2
(45) Date of Patent: May 10, 2011

(54) METHOD OF LUBRICATING A MARINE DIESEL ENGINE

(75) Inventors: Alexandra Mayhew, Workswirth (GB); Stephen J. Cook, Belper (GB)

(73) Assignee: The Lubrizol Corporation, Wickliffe, OH (US)

( * ) Notice: Subject to any disclaimer, the term of this patent is extended or adjusted under 35 U.S.C. 154(b) by 457 days.

(21) Appl. No.: 12/089,796

(22) PCT Filed: Oct. 13, 2006

(86) PCT No.: PCT/US2006/040107

§ 371 (c)(1), (2), (4) Date: Apr. 10, 2008

(87) PCT Pub. No.: WO2007/047446

PCT Pub. Date: Apr. 26, 2007

(65) Prior Publication Data

US 2008/0287327 A1 Nov. 20, 2008

Related U.S. Application Data

(60) Provisional application No. 60/726,796, filed on Oct. 14, 2005.

(51) Int. Cl.
*C10M 163/00* (2006.01)
*C10M 137/10* (2006.01)

(52) U.S. Cl. ..... 508/186; 508/185; 508/369

(58) Field of Classification Search ..... 508/186, 508/369, 185

See application file for complete search history.

(56) References Cited

U.S. PATENT DOCUMENTS

| | | | | |
|---|---|---|---|---|
| 4,842,755 | A | 6/1989 | Dunn | |
| 6,551,965 | B2 | 4/2003 | Nagamatsu et al. | |
| 2001/0003734 | A1 * | 6/2001 | Dunn | 508/197 |
| 2001/0034307 | A1 * | 10/2001 | King et al. | 508/391 |
| 2003/0196632 | A1 * | 10/2003 | Reischman et al. | 123/196 R |
| 2005/0153847 | A1 * | 7/2005 | Chambard et al. | 508/185 |

FOREIGN PATENT DOCUMENTS

| | | | |
|---|---|---|---|
| EP | 0331359 | A1 | 9/1989 |
| EP | 1298189 | A1 | 4/2003 |
| EP | 1522572 | A1 | 4/2005 |
| WO | 2007/044909 | A1 | 4/2002 |
| WO | 2006/014866 | A1 | 2/2006 |

OTHER PUBLICATIONS

CIMAC Paper No. 149, "The Assured Safe Reduction of Cylinder Oil Feed Rates", John Smythe, Infineum UK Ltd., et al., pp. 1, 3 and 4, 2007.

CIMAC No. 15, "Guidelines for the Lubrication of Two-Stroke Crosshead Diesel Engines", 1997, pp. 8-9.

CIMAC, "The Influence of the Neutralization Ability of Marine Lubricants on Engine Lubrication", Congress 2001. Hamburg, pp. 1272 and 1274.

* cited by examiner

*Primary Examiner* — Walter D Griffin
*Assistant Examiner* — Frank C Campanell
(74) *Attorney, Agent, or Firm* — David M. Shold; Christopher D. Hilker

(57) ABSTRACT

The invention provides a method of lubricating a marine diesel engine, comprising supplying to said engine a marine diesel cylinder lubricant composition at a feed rate of 0.3 to less than 1.2 g/kW hr, wherein said lubricant composition has a ratio of /Σ(wt % overbased detergent)/Σ(wt % of boron from antiwear additives+wt % of phosphorus-containing antiwear additives) of greater than 12.5. The invention further provides a method capable of imparting improved cleanliness and decreased cylinder wear; and reduced deposits.

19 Claims, No Drawings

METHOD OF LUBRICATING A MARINE DIESEL ENGINE

FIELD OF INVENTION

The present invention relates to a method of lubricating a marine diesel engine with a marine diesel cylinder lubricant feed rate of 0.3 to less than 1.2 g/kW hr.

BACKGROUND OF THE INVENTION

It is known to add various additives to an oil of lubricating viscosity to lubricate a marine diesel engine to reduce wear and improve cleanliness. Typically the marine diesel cylinder lubricant is metered into an engine at 1.2 to 1.3 g/kW hr, that is, 1.2 to 1.3 g/hr per kW of engine power. Due to environmental concerns over emissions of $SO_x$ (sulphur oxides), $NO_x$ (nitrogen oxides) and particulate matter such as soot and oxides of sulphur from fuels and a desire to reduce operational costs, it would be desirable to lubricate a marine diesel engine with a lower lubricant treat rate. Lowering the sulphur in fuel, may result in a reduction in emissions of $SO_x$ and/or $NO_x$; and allows for the lowering of lubricant treat rate. However, simply reducing the feed rate of the lubricant also reduces the treat rate of other additives, including antiwear agents and deposit control additives. As a consequence lowering the lubricant treat rate would result in the engine receiving at least one of reduced amounts of detergent (which leads to reduced amounts of TBN), reduced antiwear additives and reduced deposit control additives. Decreasing the amounts of TBN is likely to cause an increase in the amount of un-neutralised acids in the lubricant. As the amount of un-neutralised acid accumulates, this results in increased engine wear (including corrosive, abrasive or adhesive wear), increased deposit formation, and decreased cleanliness.

U.S. Pat. No. 6,551,965 discloses a marine diesel engine lubricant with improved temperature performance. The lubricant contains overbased sulphurised phenate and sulphonate detergents an ashless dispersant and a zinc diaryldithiophosphate.

The present invention provides a process for allowing for a reduction in lubricant treat rates in a cost effective manner and without the adverse effects discussed above.

SUMMARY OF THE INVENTION

The present invention in one embodiment provides a method of lubricating a marine diesel engine, comprising supplying to said engine a marine diesel cylinder lubricant composition at a feed rate of 0.3 to less than 1.2 g/kW hr, wherein said lubricant composition has a ratio of Σ(wt % overbased detergent)/Σ(wt % of boron from antiwear additives+wt % of phosphorus-containing antiwear additives) of greater than 12.5.

In another embodiment the invention provides a method of lubricating a marine diesel engine, comprising supplying to said engine a marine diesel cylinder lubricant composition at a feed rate of 0.3 to less than 1.2 g/kW hr, wherein said lubricant composition has a ratio of Σwt % overbased detergent)/Σ(wt % of boron from antiwear additives+wt % of phosphorus-containing antiwear additives) of greater than 12.5, wherein the lubricant composition contains 10 wt % or less of a base oil derived from bright stock and/or a viscosity modifier.

In another embodiment the invention provides a method of lubricating a marine diesel engine, comprising supplying to said engine a marine diesel cylinder lubricant composition at a feed rate of 0.3 to less than 1.2 g/kW hr, wherein said lubricant composition has a ratio of Σ(wt % overbased detergent)/Σ(wt % of phosphorus-containing antiwear additives) of greater than 12.5 or at least 20.

In another embodiment the invention provides a method of lubricating a marine diesel engine, comprising supplying to said engine a marine diesel cylinder lubricant composition at a feed rate of 0.3 to less than 1.2 g/kW hr, wherein said lubricant composition has a ratio of Σ(wt % overbased detergent)/Σ(wt % of boron from antiwear additives) of greater than 12.5 or at least 250.

DETAILED DESCRIPTION OF THE INVENTION

The present invention provides a method of lubricating a marine diesel engine with a feed rate of a marine diesel cylinder lubricant of 0.3 to less than 1.2 g/kW hr as defined above.

The marine diesel engine typically has a feed rate of lubricant into the engine of 0.3 g/kW hr to less than 1.2 g/kW hr, 0.5 g/kW hr to 1 g/kW hr, or 0.6 g/kW hr to 0.9 g/kW hr, or 0.65 g/kW hr to 0.85 g/kW hr.

As used herein the Σ(wt % overbased detergent) is calculated by including conventional amounts of diluent oil (typically 35 wt % to 55 wt %, for example, 45 wt %) as part of the Σ(wt % overbased detergent). Alternatively, the Σ(wt % overbased detergent) may be calculated on an actives basis, i.e., free of diluent oil. If the Σ(wt % overbased detergent) is determined on an actives basis, the ratio of Σ(wt % overbased detergent)/Σ(wt % of boron from antiwear additives+wt % of phosphorus-containing antiwear additives) is decreased accordingly from the values reported herein. For example, if the amount of diluent oil is 35 wt % of the overbased detergent, the ratio of Σ(wt % overbased detergent)/Σ(wt % of boron from antiwear additives+wt % of phosphorus-containing antiwear additives) decreases the ranges taught from 17.5 to 3000 to 11.4 to 1950. Similarly if the amount of diluent is 45 wt % the range 17.5 to 3000 is modified to 9.6 to 1650; and if the amount of diluent oil is 55 wt % the range 17.5 to 3000 is modified to 7.9 to 1350. All other ranges reported herein may be modified accordingly, as will be apparent to a person skilled in the art. The present invention thus specifically contemplates reducing each of the values of such ratios by 45% as a useful correction factor to account for the amount of diluent oil customarily present in the overbased detergent, and accordingly determining the amount of overbased detergent on an active chemical basis.

In several embodiments the ratio of Σ(wt % overbased detergent)/Σ(wt % of boron from antiwear additives+wt % of phosphorus-containing antiwear additives) is 15 or more, 20 or more, 25 or more, or 30 or more. This formula is discussed in greater detail below.

The upper ratio of Σ(wt % overbased detergent)/Σ(wt % of boron from antiwear additives+wt % of phosphorus-containing antiwear additives) may be 4500, 4000, 3500, 2000, 1000 or 500.

Examples of suitable ranges for the ratio of Σ(wt % overbased detergent)/Σ(wt % of boron from antiwear additives+wt % of phosphorus-containing antiwear additives) include greater than 12.5 to 4000, 17.5 to 3000, or 22.5 to 2000.

When the antiwear additive is a metal hydrocarbyl dithiophosphate the ratio of Σ(wt % overbased detergent)/Σ(wt % of boron from antiwear additives+wt % of phosphorus-containing antiwear additives) may be at least 20, or at least 25, or at least 35.

The marine diesel cylinder lubricant composition typically comprises a overbased detergent, a boron and phosphorus-containing antiwear additive and an oil of lubricating viscosity, wherein said lubricant composition has a ratio of Σ(wt % overbased detergent)/Σ(wt % of boron from antiwear additives+wt % of phosphorus-containing antiwear additives) of greater than 12.5.

In one embodiment the invention provides a method of lubricating a marine diesel engine, comprising supplying to said engine a marine diesel cylinder lubricant composition at a feed rate of 0.3 to less than 1.2 g/kW hr, wherein said lubricant composition has a ratio of Σ(wt % overbased detergent)/Σ(wt % of boron from antiwear additives+wt % of phosphorus-containing antiwear additives) of greater than 12.5, wherein the overbased detergent comprises a sulphonate detergent.

In one embodiment the lubricant composition contains 10 wt % or less, or less than 5 wt %, or less than 1 wt % of a base oil derived from bright stock and/or a viscosity modifier. In one embodiment the lubricant composition is free of a base oil derived from bright stock. In one embodiment the lubricant composition is free of viscosity modifier. In one embodiment the lubricant composition is free of both bright stock and viscosity modifier.

In one embodiment the lubricant composition comprises a viscosity modifier present at 0 wt % to less than 10 wt %. In one embodiment the lubricant composition comprises bright stock present at 0 wt % to less than 10 wt %. In one embodiment the lubricant composition the total sum amount of viscosity modifier and bright stock present is at 0 wt % to less than 10 wt %.

As used herein the term "free of", as used in the specification and claims, defines the absence of a material except for the amount which is present as impurities, e.g., a trace amount or a non-effective amount. Typically in this embodiment, the amount present will be less than 0.05% or less than 0.005 wt % by weight of the lubricant composition.

The lubricant composition in several embodiments may have a ratio of Σ(wt % overbased detergent)/Σ(wt % of boron from antiwear additives) of 250 to 4500, or 300 to 3000, or 500 to 2000, or 750 to 1500, or 775 to 1300.

The TBN of the lubricant composition before being added to a marine diesel engine may be at least 100 or 110 or more or 120 or more. Examples of suitable ranges for the TBN include 100 to 190 or 105 to 180 or 110 to 170.

Generally the lubricant composition, when lubricating the marine diesel engine, provides an effective engine TBN ranging from 30 to less than 100 or 35 to 90. In specific embodiments the lubricant composition when employed in the marine diesel engine has an effective engine TBN of 40 or 70.

Typically the lubricant composition supplied to the marine diesel engine with the appropriate level of TBN and antiwear chemistry for a given feed rate. This may be summarised by the formula Effective Engine TBN=V×(RFR/STDFR), wherein V is the TBN (total base number) of lubricant composition before being added to a marine diesel engine;

RFR is the desired reduced engine lubricant composition feed rate ranging from 0.3 to less than 1.2 g/kW hr);

STDFR is the standard engine lubricant composition feed rate as specified by engine manufacturers, typically ranging from 1.2 to 1.3 g/kW hr.

In one embodiment the marine diesel engine properties are monitored and the lubricant composition may be added by metering the lubricant composition at a rate to provide appropriate properties. The engine properties may be monitored by employing a device monitoring performance characteristics of the engine. It is to be understood that the term "monitoring performance characteristics of the engine" not only includes mechanical or power output measurements, but it further includes chemical or physical properties of the lubricating oil in the engine. Wear may be measured by a number of techniques including determining the metal or metal oxide particles present in scrape down lubricant from a cylinder liner. Other examples of monitoring engine performance include measuring the sulphur content of the fuel, the load of an engine and TBN of the lubricant. A more detailed description of possible techniques for monitoring performance characteristics of an engine is disclosed in US Patent Application 2003/0159672. In one embodiment the device monitoring performance characteristics of the engine measures TBN by infrared spectroscopy.

In one embodiment the TBN of the lubricant may be determined by a method of determining the total base number of a used lubricant from an open, all-loss, lubricating system comprising: (a) applying an AC voltage signal between electrodes immersed in the used lubricant, (b) measuring the used lubricant dependent response to the applied signal, and (c) determining the used lubricant base number from the measured response. A more detailed description of the method of determining TBN of the lubricant is disclosed in co-pending U.S. application Ser. No. 11/250,274 (by inventors Boyle, Kampe and Lvovich).

Overbased Detergents

The overbased detergents are known, as is the process for making overbased detergents. Overbased detergents generally have a stoichiometric excess of metal base. Typically an overbased detergent has a TBN of at least 200.

Typically the overbased detergents comprise at least one of sulphonates or phenates, or a reaction product of a sulphonate and a hydrocarbyl substituted phenol.

An overbased detergent derived from a reaction product of a sulphonate and a hydrocarbyl substituted phenol is described in more detail in WO97/046647.

Typically the phenates may contain a bridging group between aryl groups. The bridging group may be alkylene (often methylene), a sulphide or polysulphide bridge. In another embodiment the phenate may be a normal phenate i.e. free of bridging groups.

The overbased detergent may have a TBN from 200 or 245 to 600. Suitable ranges for TBN include 245 to 550 or 250 to 500. Generally an overbased detergent with a TBN of 200 to about 300 is a phenate. The more highly overbased detergents (higher TBN) tend to be sulphonates.

In one embodiment the overbased detergent is a phenate with a TBN of about 250. In another embodiment the overbased detergent comprises a sulphonate detergent.

In one embodiment the weight percent (including normal amounts of diluent oil) of overbased phenate present is less than 55 wt % of the total amount of all overbased detergent present (including sulphonate detergent); and in another embodiment the amount of overbased phenate present is less than 45 wt % of the total amount of all detergent present.

In one embodiment the overbased detergent comprises (i) an overbased phenate at less than 55 wt % of the total amount of all overbased detergent; and (ii) greater than 45 wt % of an overbased sulphonate.

When present the overbased detergent is a phenate it is present from 10 wt % or 15 wt % to 30 wt % of a concentrate package.

Sulphonate Detergent

In one embodiment the overbased detergent comprises a sulphonate detergent. The sulphonate detergent of the invention is known. The sulphonate detergent may have a TBN of 300 or more, 350 or more, 400 or more, or at least 450. The sulphonate detergent TBN typically ranges from 300 to 600, or from 350 to 550, or from 375 to 550, or from 400 to 550.

Typically, the sulphonate detergent is in the form of basic salts of basic salts of alkali, alkaline earth and transition metals. Commonly used metals include sodium, potassium, calcium, magnesium lithium or mixtures thereof. Most commonly used metals include sodium, magnesium, calcium or mixtures thereof.

The sulphonate detergent substrate includes synthetic and natural sulphonates. The sulphonates may be linear or aromatic.

The sulphonate detergent substrate may contain an oil soluble hydrocarbyl group containing 8 or more carbon atoms. Typically the oil soluble hydrocarbyl group contains up to 40, 30 or 28 carbon atoms. Typical oil soluble hydrocarbyl groups each contain 12 to 28, or 18 to 28, or 22 to 26 carbon atoms.

In different embodiments the sulphonate detergent substrate comprises aromatic (typically derived a phenyl or naphthyl) group and the oil soluble hydrocarbyl group is typically substituted on the aromatic group in one or two positions.

A sulphonate detergent with a TBN of approximately 500 and its preparation are disclosed in U.S. Pat. No. 5,792,732 or in International Application PCT/2004/036152.

International Application WO2005/042677 discloses in Examples 10 to 13, sulphonate detergents with a TBN of 450 to 500.

Example 2 of U.S. Pat. No. 5,792,732 also discloses a 500 TBN all-linear alkylbenzene sulphonate prepared by reacting an alkyl benzene sulphonate from Witco Corp. (known as Crompton and now Chemtura) with $Ca(OH)_2$ and CaO in n-heptane and methanol and bubbling with $CO_2$.

Another method for preparing an overbased sulphonate detergent of high metal ratio is disclosed in U.S. Pat. No. 6,444,625 (see, for instance, column 3, bottom).

Boron and Phosphorus-Containing Antiwear Additives

The boron and phosphorus-containing antiwear additives may be ash containing or ashless i.e. substantially free of metal.

From the formula defined above, the Σ(wt % of boron from antiwear additives+wt % of phosphorus-containing antiwear additives), is calculated by establishing whether phosphorus antiwear agents and boron antiwear agents are present. If both are present, the Σ(wt % of boron from antiwear additives+wt % of phosphorus-containing antiwear additives) is calculated using the wt % of both the boron and phosphorus antiwear agents. The wt % of the phosphorus antiwear agent is determined directly by the wt % present in the lubricant composition. The wt % of boron from antiwear additives is calculated on the amount of boron present in the additive. For example, if a boron containing antiwear agent is present at 5 wt % of the lubricant composition; and boron is present at 1 wt % in the antiwear additive, the wt % of boron is 0.05 wt %. The symbol Σ indicates the sum of all the components which follow.

In one embodiment, the lubricating composition is free of a phosphorus-containing antiwear agent. Consequently, the lubricant composition ratio is derived from a ratio of Σ(wt % overbased detergent)/Σ(wt % of boron from antiwear additives).

In one embodiment, the lubricating composition is free of a boron-containing antiwear agent. Consequently, the lubricant composition ratio is derived from a ratio of Σ(wt % overbased detergent)/Σ(wt % of phosphorus-containing antiwear additives).

The phosphorus-containing antiwear additives comprise a metal hydrocarbyl dithiophosphate, an ashless phosphorus antiwear agent or mixtures thereof.

The ashless phosphorus antiwear agent comprises at least one compound derived from phosphoric acid esters or amine salts thereof; dialkyldithiophosphoric acid esters or salt thereof; phosphites; and phosphorus-containing carboxylic esters, ethers, and amides or mixtures thereof.

Metal hydrocarbyl dithiophosphate antiwear additives are known. Examples of the metal hydrocarbyl dithiophosphate include metal hydrocarbyl dithiophosphate include barium or zinc dihydrocarbyl dithiophosphates (often referred to as ZDDP, ZDP or ZDTP). The metal hydrocarbyl dithiophosphate generally contains hydrocarbyl groups with 1 to 30, 2 to 20 or 2 to 15 carbon atoms. The hydrocarbyl groups may contain primary and/or secondary carbon atoms forming a C—O—P bond. Examples of suitable zinc hydrocarbyl dithiophosphates compounds have hydrocarbyl groups that are heptylated or octylated or nonylated.

In an alternative embodiment the antiwear agent comprises an ashless antiwear agent, i.e., the antiwear agent is metal-free. Often the metal-free antiwear agent is an amine salt of a phosphorus-containing antiwear agent. Typically the ashless antiwear agent comprises phosphoric acid esters or an amine salt thereof or salts of dialkyldithiophosphoric acid esters.

The amine is often a primary amine, a secondary amine, a tertiary amine or mixtures thereof. Often a primary amine and/or a secondary amine will contain at least one hydrocarbyl group with the number of carbon atoms present from 2 to 30, 8 to 28, 10 to 26, or 13 to 24.

Examples of primary amines useful in the present invention include ethylamine, propylamine, butylamine, 2-ethylhexylamine, octylamine or dodecylamine. Also suitable primary fatty amines which include n-octylamine, n-decylamine, n-dodecylamine, n-tetradecylamine, n-hexadecylamine, n-octadecylamine and oleyamine. Other useful fatty amines include commercially available fatty amines such as "Armeen®" amines (products available from Akzo Chemicals, Chicago, Ill.), such as Armeen C, Armeen O, Armeen OL, Armeen T, Armeen HT, Armeen S and Armeen SD, wherein the letter designation relates to the fatty group, such as coco, oleyl, tallow, or stearyl groups.

Examples of suitable secondary amines include dimethylamine, diethylamine, dipropylamine, dibutylamine, diamylamine, dihexylamine, diheptylamine, methylethylamine, ethylbutylamine and ethylamylamine. The secondary amines may be cyclic amines such as piperidine, piperazine and morpholine.

Mixtures of amines may also be used in the invention. Especially useful mixtures of amines are "Primene®" amines such as "Primene 81R" and "Primene JMT." Primene 81R and Primene JMT (both produced and sold by Rohm & Haas) are mixtures of $C_{11}$ to $C_{14}$ tertiary alkyl primary amines and $C_{18}$ to $C_{22}$ tertiary alkyl primary amines respectively.

Examples of hydrocarbyl amine salts of dialkyldithiophosphoric acid esters include the reaction product(s) of isopropyl, methyl-amyl (4-methyl-2-pentyl or mixtures thereof), 2-ethylhexyl, heptyl, octyl or nonyl dithiophosphoric acids with ethylene diamine, morpholine, or Primene 81R™, and mixtures thereof.

In one embodiment the dithiophosphoric acid may be reacted with an epoxide or a glycol. This reaction product is further reacted with a phosphorus acid, anhydride, or lower ester. The epoxide includes an aliphatic epoxide or a styrene oxide. Examples of useful epoxides include ethylene oxide, propylene oxide, butene oxide, octene oxide, dodecene oxide, styrene oxide and the like. In one embodiment the epoxide comprises propylene oxide. The glycols may be aliphatic glycols having from 1 to 12, or from 2 to 6, or 2 to 3 carbon atoms. The dithiophosphoric acids, glycols, epoxides, inorganic phosphorus reagents and methods of reacting the same are described in U.S. Pat. Nos. 3,197,405 and 3,544,465. The resulting acids may then be salted with amines. An example of a suitable dithiophosphoric derivative acid (or phosphoric acid) is prepared by adding phosphorus pentoxide (about 64 grams) at 58° C. over a period of 45 minutes to 514 grams of hydroxypropyl O,O-di(4-methyl-2-pentyl)phosphorodithioate (prepared by reacting di(4-methyl-2-pentyl)phosphorodithioic acid with 1.3 moles of propylene oxide at 25° C.). The mixture is heated at 75° C. for 2.5 hours, mixed with a diatomaceous earth and filtered at 70° C. The filtrate contains 11.8% by weight phosphorus, 15.2% by weight sulphur, and an acid number of 87 (bromophenol blue).

In an alternative embodiment the antiwear agent comprises a borated additive. Typically the borated additive is a borated ester, a borated dispersant or mixtures thereof.

The weight percent of boron present in antiwear additives (may also be referred to as borated antiwear additives) may range from 0.1 wt % to 10 wt %, or 0.51 wt % to 4, or 1 wt % to 3 wt %, or 1.5 wt % to 2.5 wt %.

In one embodiment the antiwear agent is a borated dispersant. In the present invention, the borated dispersant is known to have two properties i.e. acts as a dispersant and also has antiwear properties. Typically the borated dispersant is prepared using a variety of agents selected from the group consisting of the various forms of boric acid (including metaboric acid, $HBO_2$, orthoboric acid, $H_3BO_3$, and tetraboric acid, $H_2B_4O_7$), boric oxide, boron trioxide, and alkyl borates. In one embodiment the borating agent is boric acid which may be used alone or in combination with other borating agents.

The borated dispersant may be prepared by blending the boron compound and the N-substituted long chain alkenyl succinimides and heating them at a suitable temperature, typically 80° C. to 250° C., or 90° C. to 230° C. or 100° C. to 210° C., until the desired reaction has occurred. The molar ratio of the boron compounds to the N-substituted long chain alkenyl succinimides is typically 10:1 to 1:4, or 4:1 to 1:3, or 1:2. An inert liquid may be used in performing the reaction. The liquid may include toluene, xylene, chlorobenzene, dimethylformamide and mixtures thereof.

In an alternative embodiment the antiwear agent is a borated ester. The borated ester may be prepared by the reaction of a boron compound and at least one compound selected from epoxy compounds, halohydrin compounds, epihalohydrin compounds, alcohols and mixtures thereof. Typically the alcohols include monohydric alcohols, dihydric alcohols, trihydric alcohols or higher alcohols.

Boron compounds suitable for preparing the borate ester include a boric acid (including metaboric acid, $HBO_2$, orthoboric acid, $H_3BO_3$, and a tetraboric acid, $H_2B_4O_7$), a boric oxide, a boron trioxide and an alkyl borate. The borate ester may also be prepared from boron halides. The borated ester further contains at least one hydrocarbyl group often containing about 8 to about 30 carbon atoms.

Oils of Lubricating Viscosity

The invention further includes oil of lubricating viscosity. Such oils include natural and synthetic oils, oil derived from hydrocracking, hydrogenation, and hydrofinishing, unrefined, refined oils and re-refined oils and mixtures thereof.

Unrefined oils are those obtained directly from a natural or synthetic source generally without (or with little) further purification treatment.

Refined oils are similar to the unrefined oils except they have been further treated in one or more purification steps to improve one or more properties. Purification techniques are known in the art and include solvent extraction, secondary distillation, acid or base extraction, filtration, percolation and the like.

Re-refined oils are also known as reclaimed or reprocessed oils, and are obtained by processes similar to those used to obtain refined oils and often are additionally processed by techniques directed to removal of spent additives and oil breakdown products.

Natural oils useful in making the inventive lubricants include animal oils, vegetable oils (e.g., castor oil, lard oil), mineral lubricating oils such as liquid petroleum oils and solvent-treated or acid-treated mineral lubricating oils of the paraffinic, naphthenic or mixed paraffinic-naphthenic types and oils derived from coal or shale or mixtures thereof.

Synthetic lubricating oils are useful and include hydrocarbon oils such as polymerised and interpolymerised olefins (e.g., polybutylenes, polypropylenes, propyleneisobutylene copolymers); poly(1-hexenes), poly(1-octenes), poly(1-decenes), and mixtures thereof; alkyl-benzenes (e.g. dodecylbenzenes, tetradecylbenzenes, dinonylbenzenes, di-(2-ethylhexyl)benzenes); polyphenyls (e.g., biphenyls, terphenyls, alkylated polyphenyls); alkylated diphenyl ethers and alkylated diphenyl sulphides and the derivatives, analogs and homologs thereof or mixtures thereof.

Other synthetic lubricating oils include liquid esters of phosphorus-containing acids (e.g., tricresyl phosphate, trioctyl phosphate, and the diethyl ester of decane phosphonic acid), and polymeric tetrahydrofurans. Synthetic oils may be produced by Fischer-Tropsch reactions and typically may be hydroisomerised Fischer-Tropsch hydrocarbons or waxes.

Oils of lubricating viscosity may also be defined as specified in the American Petroleum Institute (API) Base Oil Interchangeability Guidelines. The five base oil groups are as follows: Group I (sulphur content>0.03 wt %, and/or <90 wt % saturates, viscosity index 80-120); Group II (sulphur content≦0.03 wt %, and ≧90 wt % saturates, viscosity index 80-120); Group III (sulphur content≦0.03 wt %, and ≧90 wt % saturates, viscosity index≧120); Group IV (all polyalphaolefins (PAOs)); and Group V (all others not included in Groups I, II, III, or IV). The oil of lubricating viscosity comprises an API Group I, Group II, Group III, Group IV, Group V oil and mixtures thereof. Often the oil of lubricating viscosity is an API Group I, Group II, Group III, Group IV oil and mixtures thereof. Alternatively the oil of lubricating viscosity is often an API Group I, Group II, Group III oil or mixtures thereof.

Other Performance Additives

Optionally the lubricant composition may include at least one other performance additive other than those described above, selected from the group consisting of metal deactivators, detergents other than overbased detergents, dispersants, antioxidants, antiwear agents, corrosion inhibitors, antiscuffing agents, extreme pressure agents, foam inhibitors, demulsifiers, friction modifiers, pour point depressants and mixtures thereof. Typically, fully-formulated lubricating oil will contain one or more of these performance additives.

Detergents

The lubricant composition optionally further comprises other detergents (other than those described above), and in particular neutral detergents, that is, non-overbased detergents. Typically neutral detergents have a TBN below 200. Suitable detergent substrates include, salixarates, salicylates, carboxylic acids, phosphorus acids, mono- and/or di-thiophosphoric acids, alkyl phenols, sulphur coupled alkyl phenol compounds, or saligenins.

Dispersants

Dispersants are often known as ashless-type dispersants because, prior to mixing in a lubricating oil composition, they do not contain ash-forming metals and they do not normally contribute any ash forming metals when added to a lubricant and polymeric dispersants. Ashless type dispersants are characterised by a polar group attached to a relatively high molecular weight hydrocarbon chain. Typical ashless dispersants include N-substituted long chain alkenyl succinimides. Examples of N-substituted long chain alkenyl succinimides include polyisobutylene succinimide with number average molecular weight of the polyisobutylene substituent in the range 350 to 5000, or 500 to 3000. Succinimide dispersants and their preparation are disclosed, for instance in U.S. Pat. No. 4,234,435. Succinimide dispersants are typically the imide formed from a polyamine, typically a poly (ethyleneamine).

In one embodiment the invention further comprises at least one dispersant derived from polyisobutylene succinimide with number average molecular weight in the range 350 to 5000, or 500 to 3000. The polyisobutylene succinimide may be used alone or in combination with other dispersants.

In one embodiment the invention further comprises at least one dispersant derived from polyisobutylene succinic anhydride or acid, an amine and zinc oxide to form a polyisobutylene succinimide complex with zinc. The polyisobutylene succinimide complex with zinc may be used alone or in combination.

Another class of ashless dispersant is Mannich bases. Mannich dispersants are the reaction products of alkyl phenols with aldehydes (especially formaldehyde) and amines (especially polyalkylene polyamines). The alkyl group typically contains at least 30 carbon atoms.

The dispersants may also be post-treated by conventional methods by a reaction with any of a variety of agents. Among these are urea, thiourea, dimercaptothiadiazoles, carbon disulphide, aldehydes, ketones, carboxylic acids, hydrocarbon-substituted succinic anhydrides, maleic anhydride, nitriles, epoxides, and phosphorus compounds.

Antioxidant

Antioxidant compounds are known and include a diphenylamine, a hindered phenol, a molybdenum compound (such as a molybdenum dithiocarbamate), and mixtures thereof. Antioxidant compounds may be used alone or in combination.

The hindered phenol antioxidant often contains a secondary butyl and/or a tertiary butyl group as a sterically hindering group. The phenol group is often further substituted with a hydrocarbyl group and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, 4-dodecyl-2,6-di-tert-butylphenol, or 2,6-di-tert-butylphenol. In one embodiment the hindered phenol antioxidant is an ester and may include, e.g., Irganox™ L-135 from Ciba. A more detailed description of suitable ester-containing hindered phenol antioxidant chemistry is found in U.S. Pat. No. 6,559,105.

Suitable examples of molybdenum dithiocarboamates which may be used as an antioxidant include commercial materials sold under the trade names such as Vanlube 822™ and Molyvan™ A from R. T. Vanderbilt Co., Ltd., and Adeka Sakura-Lube™ S-100, S-165 and S-600 from Asahi Denka Kogyo K. K and mixtures thereof.

Antiwear Agent

The lubricant composition optionally further comprises at least one other antiwear agent that is, other than a boron-containing or a phosphorus-containing antiwear agent. Optional other antiwear agents are not included in the calculation determining the ratio of Σ(wt % overbased detergent)/Σ(wt % of boron from antiwear additives+wt % of phosphorus-containing antiwear additives).

Examples of suitable antiwear agents include a sulphurised olefin, sulphur-containing ashless anti-wear additives are thiocarbamate-containing compounds, such as thiocarbamate esters, thiocarbamate amides, thiocarbamic ethers, alkylene-coupled thiocarbamates, and bis(S-alkyldithiocarbamyl) disulphides.

The dithiocarbamate-containing compounds may be prepared by reacting a dithiocarbamate acid or salt with an unsaturated compound. The dithiocarbamate containing compounds may also be prepared by simultaneously reacting an amine, carbon disulphide and an unsaturated compound. Generally, the reaction occurs at a temperature from 25° C. to 125° C. U.S. Pat. Nos. 4,758,362 and 4,997,969 describe dithiocarbamate compounds and methods of making them.

Examples of suitable olefins that may be sulphurised to form an the sulphurised olefin include propylene, butylene, isobutylene, pentene, hexane, heptene, octane, nonene, decene, undecene, dodecene, undecyl, tridecene, tetradecene, pentadecene, hexadecene, heptadecene, octadecene, octadecenene, nonodecene, eicosene or mixtures thereof. In one embodiment, hexadecene, heptadecene, octadecene, octadecenene, nonodecene, eicosene or mixtures thereof and their dimers, trimers and tetramers are especially useful olefins. Alternatively, the olefin may be a Diels-Alder adduct of a diene such as 1,3-butadiene and an unsaturated ester such as butyl(meth)acrylate.

Another class of sulphurised olefin includes fatty acids and their esters. The fatty acids are often obtained from vegetable oil or animal oil; and typically contain 4 to 22 carbon atoms. Examples of suitable fatty acids and their esters include triglycerides, oleic acid, linoleic acid, palmitoleic acid or mixtures thereof. Often, the fatty acids are obtained from lard oil, tall oil, peanut oil, soybean oil, cottonseed oil, sunflower seed oil or mixtures thereof. In one embodiment fatty acids and/or ester are mixed with olefins.

In an alternative embodiment, the ashless antiwear agent may be a monoester of a polyol and an aliphatic carboxylic acid, often an acid containing 12 to 24 carbon atoms. Often the monoester of a polyol and an aliphatic carboxylic acid is in the form of a mixture with a sunflower oil or the like, which may be present in the friction modifier mixture from 5 to 95, in several embodiments from 10 to 90, or 20 to 85, or 20 to 80 weight percent of said mixture. The aliphatic carboxylic acids (especially a monocarboxylic acid) which form the esters are those acids typically containing 12 to 24 or 14 to 20 carbon atoms. Examples of carboxylic acids include dodecanoic acid, stearic acid, lauric acid, behenic acid, and oleic acid.

Polyols include diols, triols, and alcohols with higher numbers of alcoholic OH groups. Polyhydric alcohols include ethylene glycols, including di-, tri- and tetraethylene glycols; propylene glycols, including di-, tri- and tetrapropylene glycols; glycerol; butane diol; hexane diol; sorbitol; arabitol; mannitol; sucrose; fructose; glucose; cyclohexane diol; erythritol; and pentaerythritols, including di- and tripentaerythritol. Often the polyol is diethylene glycol, triethylene glycol, glycerol, sorbitol, pentaerythritol or dipentaerythritol.

The commercially available monoester known as "glycerol monooleate" is believed to include 60±5 percent by weight of the chemical species glycerol monooleate, along with 35±5 percent glycerol dioleate, and less than 5 percent trioleate and oleic acid.

Antiscuffing Agent

The lubricant composition may also contain an antiscuffing agent. Antiscuffing agent compounds are believed to decrease adhesive wear are often sulphur containing compounds. Typically the sulphur containing compounds include organic sulphides and polysulphides, such as dibenzyldisulphide, bis-(chlorobenzyl) disulphide, dibutyl tetrasulphide, di-tertiary butyl polysulphide, sulphurised methyl ester of oleic acid, sulphurised alkylphenol, sulphurised dipentene, sulphurised terpene, sulphurised Diels-Alder adducts, alkyl sulphenyl N'N-dialkyl dithiocarbamates, the reaction product of polyamines with polybasic acid esters, chlorobutyl esters of 2,3-dibromopropoxyisobutyric acid, acetoxymethyl esters of dialkyl dithiocarbamic acid and acyloxyalkyl ethers of xanthogenic acids and mixtures thereof.

Extreme Pressure Agents

Extreme Pressure (EP) agents that are soluble in the oil include sulphur- and chlorosulphur-containing EP agents, chlorinated hydrocarbon EP agents and phosphorus EP agents. Examples of such EP agents include chlorinated wax; organic sulphides and polysulphides such as dibenzyldisulphide, bis-(chlorobenzyl) disulphide, dibutyl tetrasulphide, sulphurised methyl ester of oleic acid, sulphurised alkylphenol, sulphurised dipentene, sulphurised terpene, and sulphurised Diels-Alder adducts; phosphosulphurised hydrocarbons such as the reaction product of phosphorus sulphide with turpentine or methyl oleate; phosphorus esters such as the dihydrocarbon and trihydrocarbon phosphites, e.g., dibutyl phosphite, diheptyl phosphite, dicyclohexyl phosphite, pentylphenyl phosphite; dipentylphenyl phosphite, tridecyl phosphite, distearyl phosphite and polypropylene substituted phenol phosphite; metal thiocarbamates such as zinc dioctyldithiocarbamate and barium heptylphenol diacid; the zinc salts of a phosphorodithioic acid; amine salts of alkyl and dialkylphosphoric acids, including, for example, the amine salt of the reaction product of a dialkyldithiophosphoric acid with propylene oxide; and mixtures thereof.

Other performance additives such as corrosion inhibitors including octylamine octanoate, condensation products of dodecenyl succinic acid or anhydride and a fatty acid such as oleic acid with a polyamine; metal deactivators including derivatives of benzotriazoles, 1,2,4-triazoles, benzimidazoles, 2-alkyldithiobenzimidazoles or 2-alkyldithiobenzothiazoles; foam inhibitors including copolymers of ethyl acrylate and 2-ethylhexylacrylate and optionally vinyl acetate; demulsifiers including trialkyl phosphates, polyethylene glycols, polyethylene oxides, polypropylene oxides and (ethylene oxide-propylene oxide) polymers; pour point depressants including esters of maleic anhydride-styrene, polymethacrylates, polyacrylates or polyacrylamides; and friction modifiers including fatty acid derivatives such as amines, esters, epoxides, fatty imidazolines, condensation products of carboxylic acids and polyalkylene-polyamines and amine salts of alkylphosphoric acids may also be used in the lubricant composition.

In one embodiment the lubricant composition contains 10 wt % or less of a base oil derived from bright stock and/or a viscosity modifier. In another embodiment the lubricant composition is substantially free of a base oil derived from bright stock and/or a viscosity modifier. The viscosity modifier includes styrene-butadiene rubbers, ethylene-propylene copolymers, hydrogenated styrene-isoprene polymers, hydrogenated radical isoprene polymers, poly(meth)acrylate acid esters, polyalkyl styrenes, polyolefins, polyalkylmethacrylates and esters of maleic anhydride-styrene copolymers.

As used herein, the term "normal amounts of diluent oil" means the amount of diluent oil present in a commercially available sample of the additive to provide a low enough viscosity for ease of handling. This is often 10 wt % or 60 wt %, or 20 wt % to 50 wt %, depending on the additive.

In several embodiments the lubricant composition, when in the form of a concentrate, has additives present (wt % of concentrate) in ranges as shown in Tables 1a and 1b including normal amounts of diluent oil (derived from an oil of lubricating viscosity). Typically the oil of lubricating viscosity is an API Group I or Group II base oil, optionally containing brightstock.

TABLE 1a

| | Embodiments | | | |
|---|---|---|---|---|
| Additive | 1 | 2 | 3 | 4 |
| overbased detergent | 55-96 | 62-94 | 62-92 | 63-90 |
| boron and phosphorus-containing antiwear | 0.1-10 | 0.5-9 | 1-8 | 2-7 |
| other performance additives | 0-35 | 2-35 | 4-30 | 8-30 |

TABLE 1b

| | Embodiments | | | |
|---|---|---|---|---|
| Additive | 1 | 2 | 3 | 4 |
| sulphonate detergent | 55-95 | 62-85 | 62-80 | 68-75 |
| boron and phosphorus-containing antiwear | 0.1-10 | 0.5-9 | 1-8 | 2-7 |
| other performance additives | 0-35 | 6-35 | 12-30 | 18-30 |

INDUSTRIAL APPLICATION

Lubricant compositions of the present invention are useful in a marine diesel engine with a feed rate of a marine diesel cylinder lubricant of 0.3 to less than 1.2 g/kW hr. The marine diesel engine may be 2-stroke or 4-stroke. In one embodiment the marine diesel engine is a 2-stroke engine.

In one embodiment the invention provides for the use of a lubricant composition with a ratio of Σ(wt % overbased detergent)/Σ(wt % of boron from antiwear additives+wt % of phosphorus-containing antiwear additives) of greater than 12.5, as a marine diesel lubricant for imparting one or more properties selected from cleanliness, reduced wear (especially cylinder wear) and reduced deposits.

The following examples provide an illustration of the invention. These examples are non exhaustive and are not intended to limit the scope of the invention.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

(i) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

(ii) substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulphoxy);

(iii) hetero substituents, that is, substituents which, while having a predominantly hydrocarbon character, in the context of this invention, contain other than carbon in a ring or chain otherwise composed of carbon atoms. Heteroatoms include sulphur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

It is known that some of the materials described above may interact in the final formulation, so that the components of the final formulation may be different from those that are initially added. The products formed thereby, including the products formed upon employing lubricant composition of the present invention in its intended use, may not be susceptible of easy description. Nevertheless, all such modifications and reaction products are included within the scope of the present invention; the present invention encompasses lubricant composition prepared by admixing the components described above.

EXAMPLES

Concentrate Examples 1-4 (CE1 to CE4) are prepared by blending additives containing normal amounts of diluent oil in the amounts shown in Table 2.

TABLE 2

| Additive | CE1 | CE2 | CE3 | CE4 |
|---|---|---|---|---|
| 400 TBN sulphonate | 69 | 71.1 | 69 | 57.5 |
| 150 TBN phenate | 20.5 | 15 | 20.5 | — |
| 250 TBN phenate | — | — | — | 30 |
| borated succinimide dispersant | 3.3 | 3.3 | 1.5 | 3.3 |
| non-borated succinimide dispersant | 5 | 5 | 5 | 5 |
| zinc dialkyldithiophosphate | 1.1 | 1.1 | 0.5 | 1.1 |
| sulphurised olefin | 1.1 | 1.1 | 0.5 | 1.1 |
| TBN of concentrate | 311.2 | 311.7 | 310.1 | 311.4 |
| Formula 1* | 59.3 | 61.1 | 130.6 | 75.3 |
| Formula 2* | 62.7 | 64.6 | 138.0 | 79.6 |
| Formula 3* | 1100 | 1134 | 2421 | 1395 |
| Formula 1a* | + | + | + | 49.5 |
| Formula 2a* | + | + | + | 52.3 |
| Formula 3a* | + | + | + | 917.1 |

*Footnote to Table 2:
Formula 1 is the ratio of Σ(wt % overbased detergent)/Σ (wt % of boron from antiwear additives and wt % of phosphorus-containing antiwear additives).
Formula 2 is the ratio of Σ(wt % overbased detergent)/Σ (wt % of phosphorus-containing antiwear additives).
Formula 3 is the ratio of Σ(wt % overbased detergent)/Σ (wt % of boron from antiwear additives).

Formula 1a, Formula 2a and Formula 3a are the same as Formula 1, Formula 2 and Formula 3 respectively, except the overbased detergent included in the calculations for 1a to 3a is only the overbased sulphonate, thus excluding the 250 TBN phenate of CE4 (note: the 150 TBN phenate (with a substrate level of 50 wt % or more of the detergent)) is not considered as overbased and thus is not included in any of the calculations). A hyphen "+" means that the value from Formula 1a, 2a, or 3a is the same as the value from Formula 1, 2, or 3, respectively.

Concentrate Examples 1-4 are added to an oil of lubricating viscosity derived from 500N or 600N base oil to form a SAE 50 oil. The SAE 50 oil is then fed into a marine diesel engine at feed rates of 0.65 g/kW hr and 0.8 g/kW hr. The marine engine is provided with the following:

TABLE 3

| Engine feed rate speed (g/kW hr) | Concentrate Example | CE Treat Rate in SAE 50 oil (wt %) | Effective Engine TBN |
|---|---|---|---|
| 0.65 | CE1 | 45.5 | 70.6 |
| 0.8 | CE1 | 36.9 | 70.7 |
| 0.65 | CE2 | 45.5 | 70.8 |
| 0.8 | CE2 | 36.9 | 70.8 |
| 0.65 | CE3 | 45.5 | 70.4 |
| 0.8 | CE3 | 36.9 | 70.4 |
| 0.65 | CE4 | 45.5 | 70.7 |
| 0.8 | CE4 | 36.9 | 70.7 |

Overall the lubricant composition used at a feed rate of 0.3 to less than 1.2 g/kW hr in a marine diesel engine provides one or more acceptable performance properties selected from cleanliness, reduced wear and reduced deposits.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." It is to be understood that the upper and lower amount, range, and ratio limits set forth herein may be independently combined. Similarly, the ranges and amounts for each element of the invention may be used together with ranges or amounts for any of the other elements.

What is claimed is:

1. A method of lubricating a 2-stroke marine diesel engine, comprising supplying to said engine a marine diesel cylinder lubricant composition at a feed rate of 0.6 g/kW hr to 0.9 g/kW hr, wherein said lubricant composition has a ratio of Σ(wt % overbased detergent)/Σ(wt % of boron from antiwear additives+wt % of phosphorus-containing antiwear additives) of 22.5 to 2000.

2. The method of claim 1, wherein the lubricant composition ratio is derived from a ratio of Σ(wt % overbased detergent)/Σ(wt % of boron from antiwear additives) when the lubricating composition is free of a phosphorus-containing antiwear agent.

3. The method of claim 2, wherein the ratio of Σ(wt % overbased detergent)/Σ(wt % of boron from antiwear additives) is at least about 250.

4. The method of claim 3, wherein the ratio of Σ(wt % overbased detergent)/Σ(wt % of boron from antiwear additives) ranges from about 775 to about 1300.

5. The method of claim 1, wherein the lubricant composition ratio is derived from a ratio of Σ(wt % overbased detergent)/Σ(wt % of phosphorus-containing antiwear additives) when the lubricating composition is free of a boron-containing antiwear agent.

6. The method of claim 1, wherein the overbased detergent comprises a sulphonate detergent.

7. The method of claim 6, wherein the sulphonate detergent has a TBN of about 350 or more.

8. The method of claim 1, wherein the overbased detergent comprises (i) an overbased phenate at less than about 55 wt % of the total amount of all overbased detergent; and (ii) greater than about 45 wt % of an overbased sulphonate.

9. The method of claim 1, wherein the boron is from antiwear additives comprising a borated ester, a borated dispersant or mixtures thereof.

10. The method of claim 1, wherein the phosphorus antiwear additives comprise a metal hydrocarbyl dithiophosphate, an ashless phosphorus antiwear agent or mixtures thereof.

11. The method of claim 1, wherein the lubricant composition being added to a marine diesel engine has a TBN of at least about 100.

12. The method of claim 1, wherein the lubricant composition when lubricating the marine diesel engine has an effective engine TBN ranging from about 35 to about 90.

13. The method of claim 1, wherein the marine diesel cylinder lubricant composition further comprises bright stock in an amount of less than about 10 wt %.

14. The method of claim 1, wherein the marine diesel cylinder lubricant composition further comprises a viscosity modifier in an amount of 0 wt % to less than about 10 wt %.

15. The method of claim 1, wherein the marine diesel cylinder lubricant composition further comprises a viscosity modifier and bright stock, wherein the total sum amount of viscosity modifier and bright stock present is less than about 10 wt %.

16. The method of claim 1, wherein the lubricant composition is free of a base oil derived from bright stock and/or a viscosity modifier.

17. A method of lubricating a 2-stroke marine diesel engine, comprising supplying to said engine a marine diesel cylinder lubricant composition at a feed rate of 0.6 g/kW hr to 0.9 g/kW hr, wherein said lubricant composition has a ratio of Σ(wt % overbased detergent)/Σ(wt % of boron from antiwear additives+wt % of phosphorus-containing antiwear additives) of 22.5 to 2000, wherein the overbased detergent comprises a sulfonate detergent.

18. The method of claim 1, wherein The TBN of the lubricant composition before being added to a marine diesel engine is 105 to 180.

19. The method of claim 1, wherein the TBN of the lubricant composition before being added to a marine diesel engine is 110 to 170.

* * * * *